US010088277B2

(12) United States Patent
Zimmer

(10) Patent No.: US 10,088,277 B2
(45) **Date of Patent: *Oct. 2, 2018**

(54) MULTIPLE ACCESSORY GUN MOUNT

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/206,368

(22) Filed: Jul. 11, 2016

(65) Prior Publication Data

US 2016/0320160 A1 Nov. 3, 2016

Related U.S. Application Data

(63) Continuation of application No. 14/457,978, filed on Aug. 12, 2014, now Pat. No. 9,488,446.

(60) Provisional application No. 61/864,983, filed on Aug. 12, 2013.

(51) Int. Cl.

| | |
|---|---|
| ***F41G 11/00*** | (2006.01) |
| ***F41G 1/02*** | (2006.01) |
| ***F41G 1/35*** | (2006.01) |

(52) U.S. Cl.

CPC ..... *F41G 11/003* (2013.01); *F41G 1/02* (2013.01); *F41G 1/35* (2013.01)

(58) Field of Classification Search

CPC . F41C 27/00; F41G 1/387; F41G 1/38; F41G 11/003; F41G 11/00

USPC ..... 42/90, 112, 124–127, 146, 106

See application file for complete search history.

(56) References Cited

U.S. PATENT DOCUMENTS

| | | | | |
|---|---|---|---|---|
| 6,490,822 | B1 | 12/2002 | Swan | |
| 6,499,245 | B1 | 12/2002 | Swan | |
| 6,618,976 | B1 | 9/2003 | Swan | |
| D510,120 | S | 9/2005 | Ding | |
| D513,056 | S | 12/2005 | Ding | |
| D513,298 | S | 12/2005 | Ding | |
| D513,633 | S | 1/2006 | Ding | |
| D533,618 | S | 12/2006 | Swan | |
| RE39,465 | E | 1/2007 | Swan | |
| D542,880 | S | 5/2007 | Cheng | |
| 7,458,179 | B2 | 12/2008 | Swan | |
| 9,488,446 | B2 * | 11/2016 | Zimmer | F41G 11/003 |
| 2004/0000083 | A1 | 1/2004 | Grant | |
| 2005/0241211 | A1 | 11/2005 | Swan | |
| 2012/0017482 | A1 | 1/2012 | Chvala | |
| 2014/0259854 | A1 * | 9/2014 | Williams | F41G 11/003 42/124 |
| 2015/0040456 | A1 | 2/2015 | Zimmer | |

* cited by examiner

*Primary Examiner* — Jonathan C Weber

(74) *Attorney, Agent, or Firm* — F. Wayne Thompson, Jr.; Asgaard Patent Services, LLC

(57) ABSTRACT

Implementations of a multiple accessory gun mount are provided. In some implementations, through the use of interchangeable accessory adaptors, a user may configure the multiple accessory gun mount to position and secure a variety of accessories in a variety of configurations on a firearm. In some implementations, the multiple accessory gun mount may comprise a hub having a top side, a bottom side, and a first side. In some implementations, an accessory such as a front sight may be secured directly to the top side of the hub. In some implementations, an accessory adaptor may be secured to the top side, the first side, and/or the second side of the hub. In this way, an end user may use one or more accessory adaptors to secure one or more firearm accessories to the hub in a variety of configurations based on the end user's needs and/or preferences.

29 Claims, 7 Drawing Sheets

MULTIPLE ACCESSORY GUN MOUNT

CROSS REFERENCE TO RELATED APPLICATION

This is a continuation application claiming the benefit of U.S. patent application Ser. No. 14/457,978, which was filed on Aug. 12, 2014, which claims the benefit of U.S. Provisional Application No. 61/864,983, which was filed on Aug. 12, 2013, both applications are incorporated herein by reference in their entirety.

TECHNICAL FIELD

This disclosure relates to implementations of a multiple accessory gun mount.

BACKGROUND

Modern firearms (e.g., handguns, rifles, and shotguns) are frequently used in conjunction with a variety of accessories to enhance the capabilities of the user. Accessories used in conjunction with a firearm may include, for example, mechanical and/or optical gun sights, visual and/or infrared illumination devices, spare battery container, and/or lasers. Due to the variety of accessories available, a user may want to attach multiple accessories to a single firearm. The accessories to be attached to a particular firearm will be based on the purpose for which the firearm is being configured, for example, warfighting, hunting, and/or competitive shooting.

A variety of mounting options have been developed to facilitate the attachment of accessories to various firearms. Typically, a mount allows for the attachment of only one accessory to a firearm. Thus, when attaching two or more accessories to a firearm, multiple mounts are typically needed. Because the real estate on firearms is limited, optimal positioning of the accessories may be limited as a result of their accompanying mounts. Further, the use of multiple mounts increases the overall weight of the firearm to which they are attached.

Furthermore, some existing mounts are designed for a specific accessory, thus, interchangeability of the different accessories is limited.

DETAILED DESCRIPTION

Implementations of a multiple accessory gun mount are provided. In some implementations, through the use of interchangeable accessory adaptors, a user may configure the multiple accessory gun mount to position and secure a variety of accessories in a variety of configurations on a firearm.

In some implementations, the multiple accessory gun mount may comprise a hub having a top side, a bottom side, a first side, a second side, a clamp, and a screw. In some implementations, an accessory such as a fixed front sight or a folding front sight may be secured directly to the top side of the hub.

In some implementations, an accessory adaptor such as an offset accessory rail, a forward accessory rail, a ring mount, and/or an extension rail may be secured to the top side, the first side, and/or the second side of the hub. In this way, an end user may use one or more accessory adaptors to secure, for example, mechanical and/or optical gun sights, visual and/or infrared illumination devices, a battery compartment, a camera mount, and/or laser(s) to the hub in a variety of configurations based on the end user's needs and/or preferences.

In some implementations, the first side and/or the second side are off set at an angle relative to the top side of the hub. In this way, attached accessories may be better positioned for use.

Figure 1A:
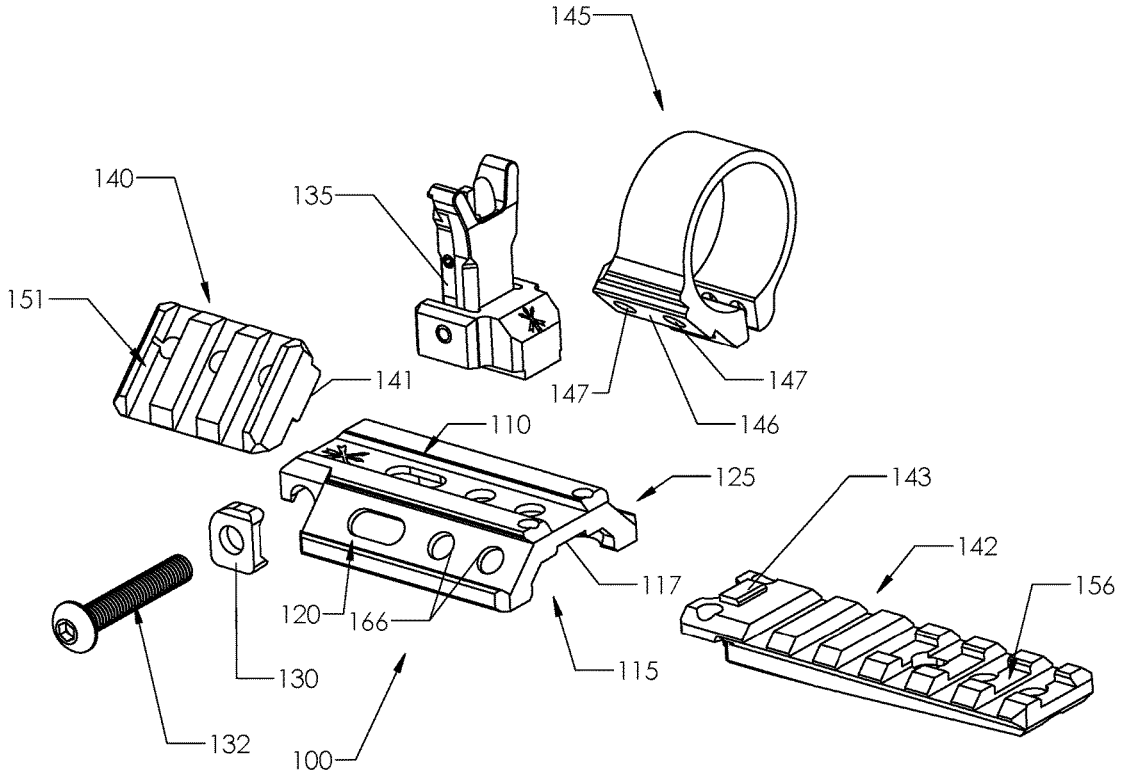
FIGS. 1A and 1B illustrate an example multiple accessory gun mount according to the present disclosure.
Figure 1B:
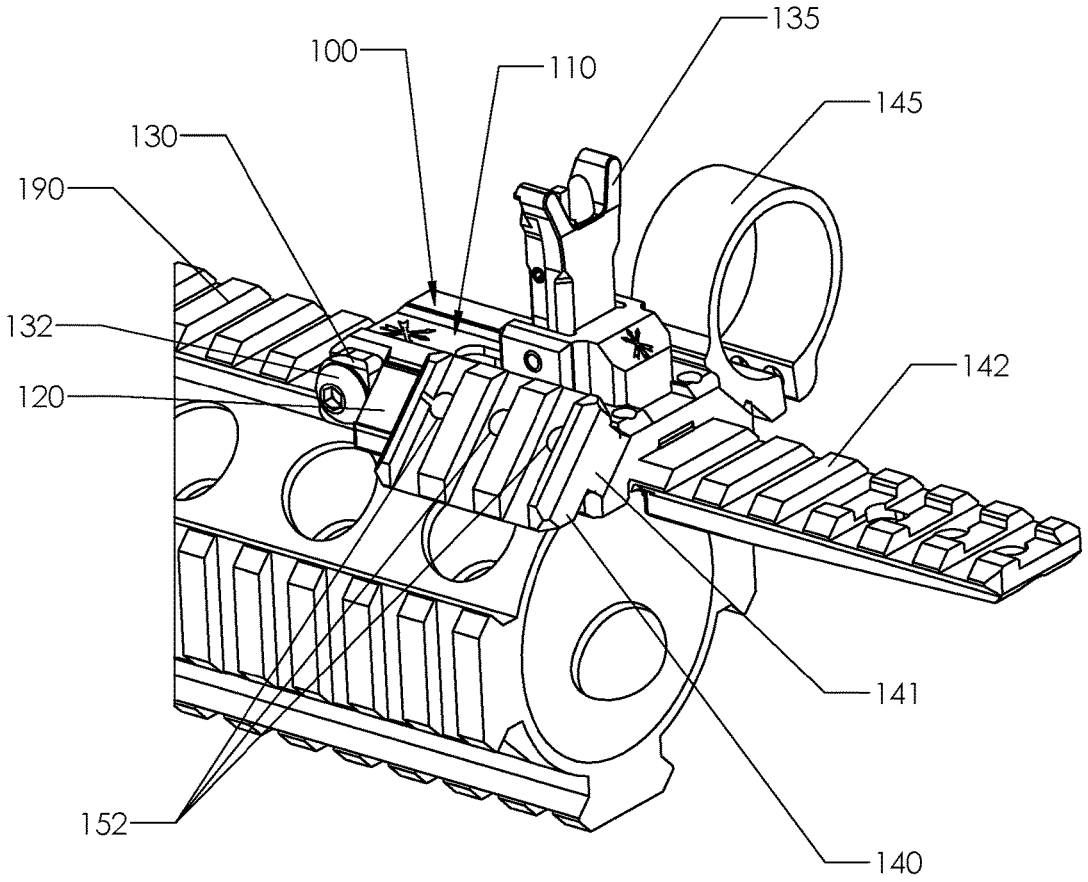

FIGS. 1A and 1B illustrate an example multiple accessory gun mount comprising a hub 100 and a plurality of accessory adaptors (e.g., accessory adaptors 140, 142, 145) according to the present disclosure. Through the use of interchangeable accessory adaptors, a user may configure the hub 100 to position and secure a variety of accessories in a variety of configurations on a firearm.

As shown in FIGS. 1A and 1B, in some implementations, the multiple accessory gun mount may comprise a hub 100 having a top side 110, a bottom side 115, a first side 120, a second side 125, a clamp 130, and a screw 132. In some implementations, an accessory such as a fixed front sight or a folding front sight 135 may be secured directly to the top side 110 of the hub 100 (see, e.g., FIG. 1B).

Figure 4:
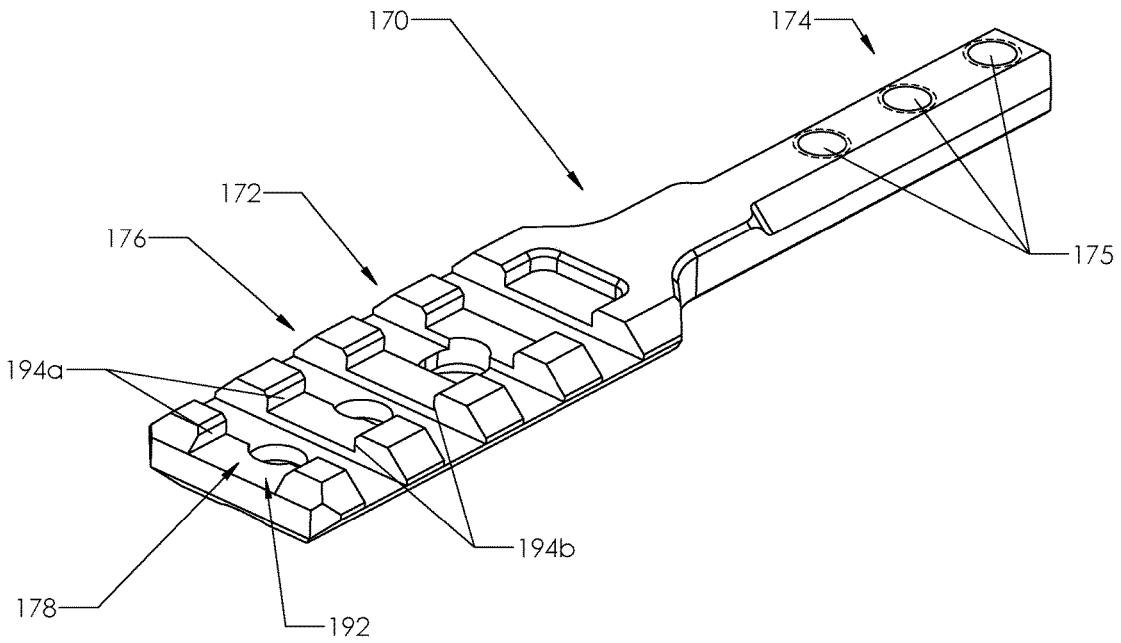

In some implementations, an accessory adaptor such as an offset accessory rail 140, a forward accessory rail 142, a ring mount 145, and/or an extension rail 170 may be secured to the top side 110, the first side 120, and/or the second side 125 of the hub 100 (see, e.g., FIG. 1B, FIG. 4). In this way, an end user may use one or more accessory adaptors to secure, for example, mechanical and/or optical gun sights, visual and/or infrared illumination devices, and/or laser(s) to the hub 100 in a variety of configurations based on the end user's needs and/or preferences.

Figure 2A:
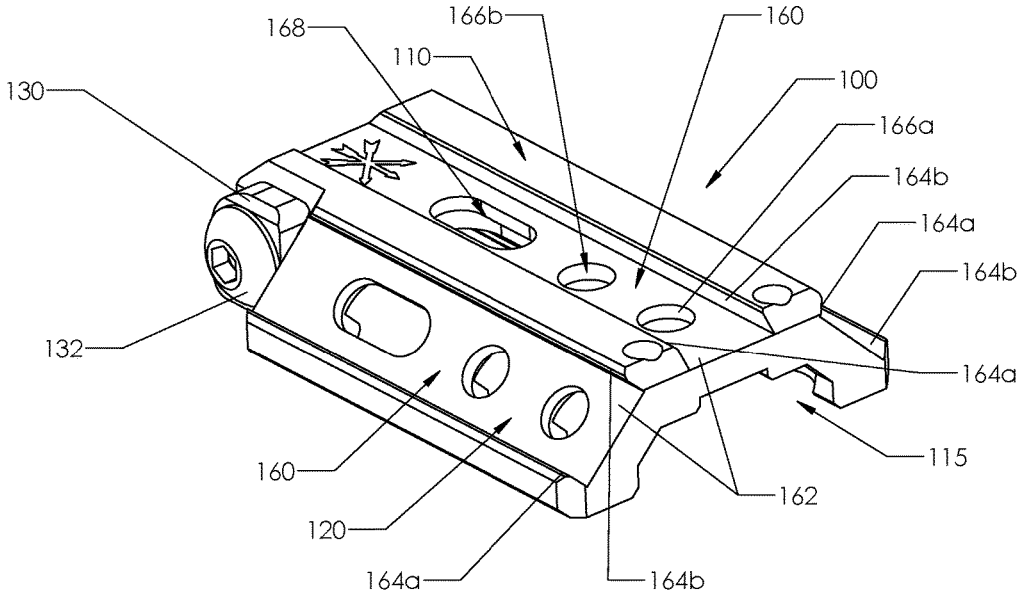
FIGS. 2A-2D illustrate an example hub according to the present disclosure.
Figure 2B:
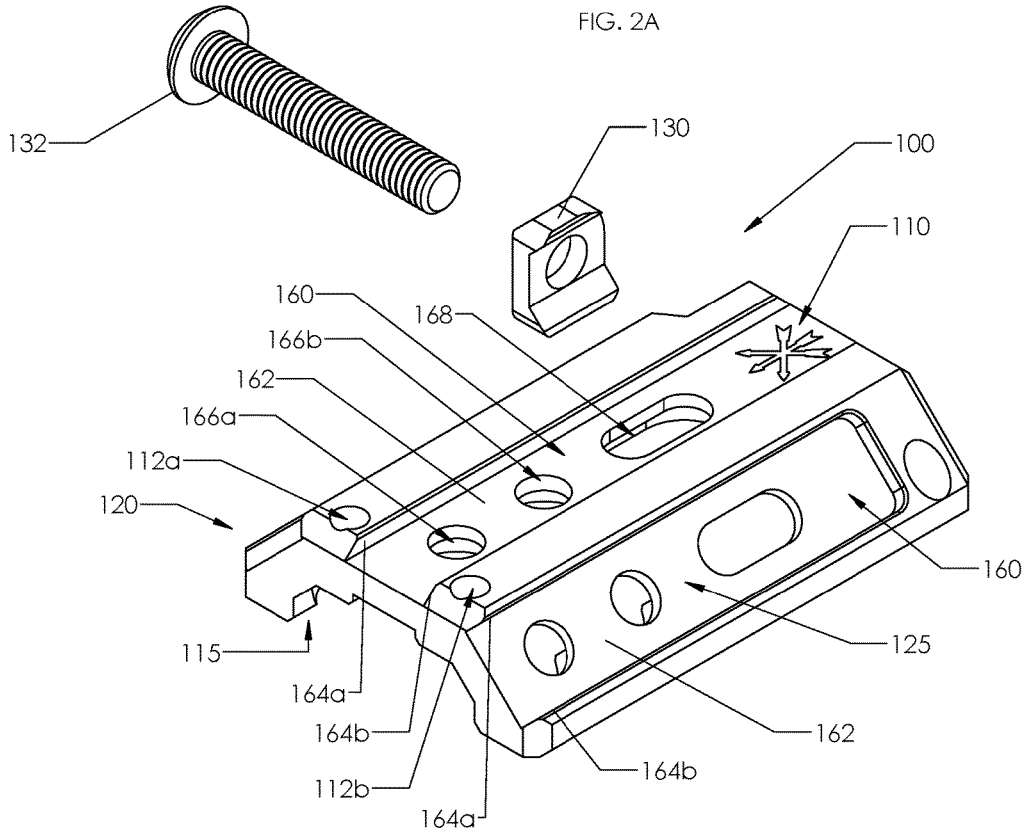
Figure 2D:
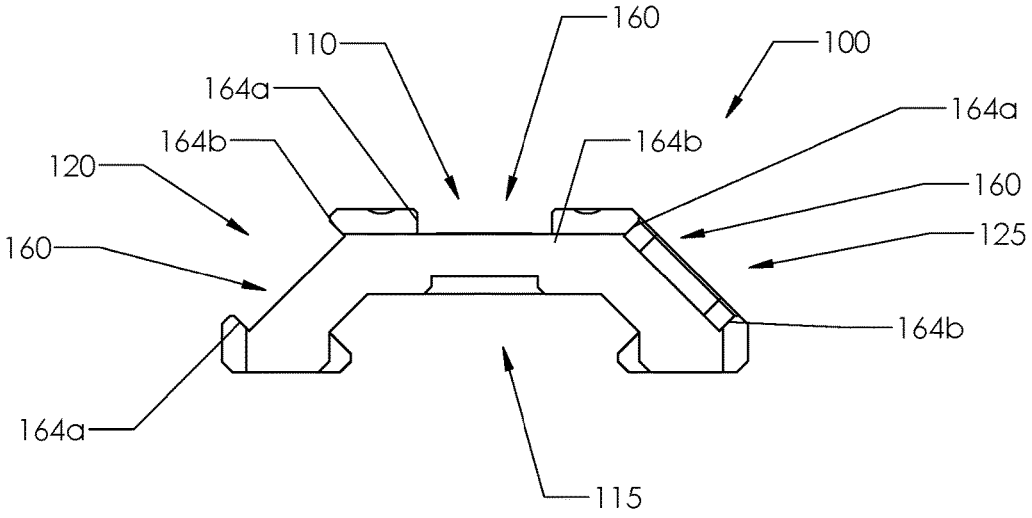
Figure 2C:
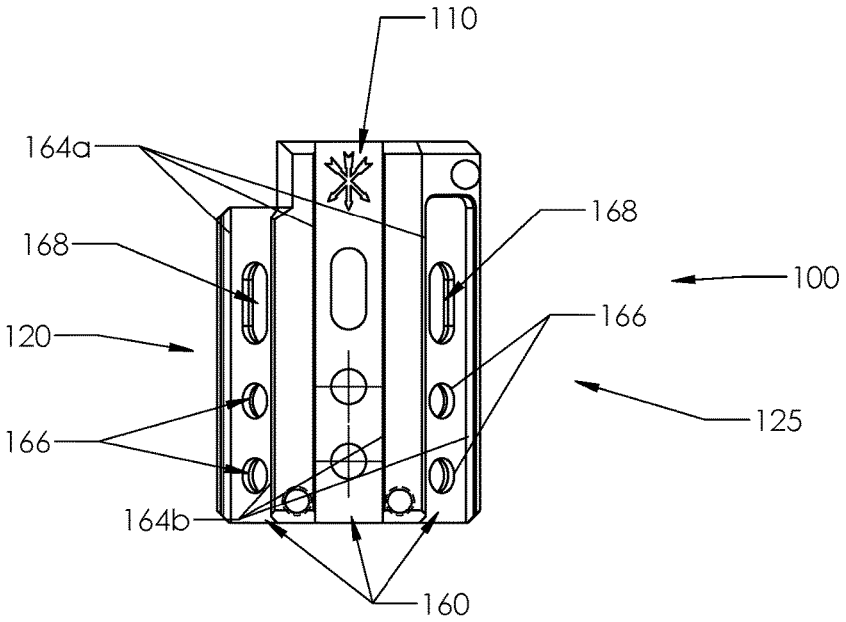

In some implementations, the first side 120 and/or the second side 125 may be offset at a 45 degree angle relative to the top side 110 of the hub 100 (see, e.g., FIGS. 1A and 2D). In some implementations, the first side 120 and/or the second side 125 may be offset by an angle less than 45 degrees and/or greater than 45 degrees relative to the top side 110 of the hub 100.

In some implementations, as shown in FIGS. 2A-2D, the top side 110, the first side 120, and/or the second side 125 of the hub 100 may include a mounting interface 160 thereon configured to receive therein a portion of an accessory adaptor attached to an accessory. In some implementations, an accessory may be configured to secure directly to the mounting interface 160 without an accessory adaptor (see, e.g., element 135, FIG. 1B).

In some implementation, the mounting interface 160 may be comprised of a channel 162. In some implementations, the channel 162 may be recessed into the top side 110, the first side 120 and/or the second side 125 of the hub 100. In some implementations, the channel 162 may be bound on two sides by a ridge 164*a*, 164*b* (referred to as ridges 164 collectively) (see, e.g., FIG. 2D). In some implementations, the channel 162 may have a ridge on less than two and/or more than two sides. In some implementations, the ridges 164 of a single mounting interface 160 may be parallel to each other (see, e.g, FIG. 2D). In some implementations, the ridges 164 may not be parallel to each other.

In some implementations, each mounting interface 160 may be further comprised of two through holes 166*a*, 166*b* (referred to as through holes 166 collectively) and/or one slot 168 (see, e.g., FIG. 2A). In some implementations, the through holes 166 and/or slot 168 extend through the channel 162 of the mounting interface 160 (see, e.g., FIG. 2C). In some implementations, the through holes 166 and/or slot 168 do not extend through the channel 162 of the mounting interface 160.

In some implementations, there may be more than two or less than two through holes 166 in the channel 162 of a mounting interface 160. In some implementations, each through hole 166*a*, 166*b* may be configured to receive a screw or similar fastening means therein (e.g., a bolt). In some implementations, the through holes 166 may be threaded. In some implementations, the through holes 166 may not be threaded.

In some implementations, there may be more than one slot 168 in the channel 162 of a mounting interface 160. In some implementations, the slot 168 may be configured to receive a portion of an accessory therein, for example, a lug of a laser aiming module. In this way, the accessory may be attached and/or stabilized on the hub 100. In some implementations, the slot 168 may be configured to receive a screw or similar fastening means therethrough.

In some implementations, the top side 110 of the hub 100 may have two threaded openings 112*a*, 112*b* outside the channel 162 (referred to as threaded openings 112 collectively) extending through the hub 100 (see, e.g., FIG. 2B). In some implementations, the openings 112 may not be threaded. In some implementations, there may be more than two or less than two threaded openings 112 on the top side 110 of the hub 100 outside the channel 162.

In some implementations, as shown in FIG. 1B, the bottom side 115 of the hub 100 may be configured to be secured to a firearm. In some implementations, the bottom side 115 of the hub 100 may be configured to be secured to the handguard of the firearm. In some implementations, the bottom side 115 may be configured to be secured to a MIL-STD-1913 rail 190 (see, e.g., FIG. 1B). In some implementations, the bottom side 115 may be configured to be secured to a KeyMod interface. In some implementations, the bottom side 115 may be configured to be secured to an M-LOK interface. In some implementations, the bottom side 115 may be configured to be secured to any interface suitable for use with a firearm.

As shown in FIG. 1B, in some implementations, a screw 132 and clamp 130 may be used to secure the hub 100 to a suitable interface of the firearm. In some implementations, a screw 132 and clamp 130 may not be used to secure the hub 100 to a suitable interface. In some implementations, a throw lever (not shown) and/or other suitable fastening device may be used to secure the hub 100 to a suitable interface.

As shown in FIG. 1A, in some implementations, the bottom side 115 of the hub 100 may include a notch 117 therein. In some implementations, the notch 117 may be configured to receive a projection 143 (discussed in greater detail below) extending from the top side 155 of the forward accessory rail 142 (see, e.g. FIG. 1B).

Figure 3:
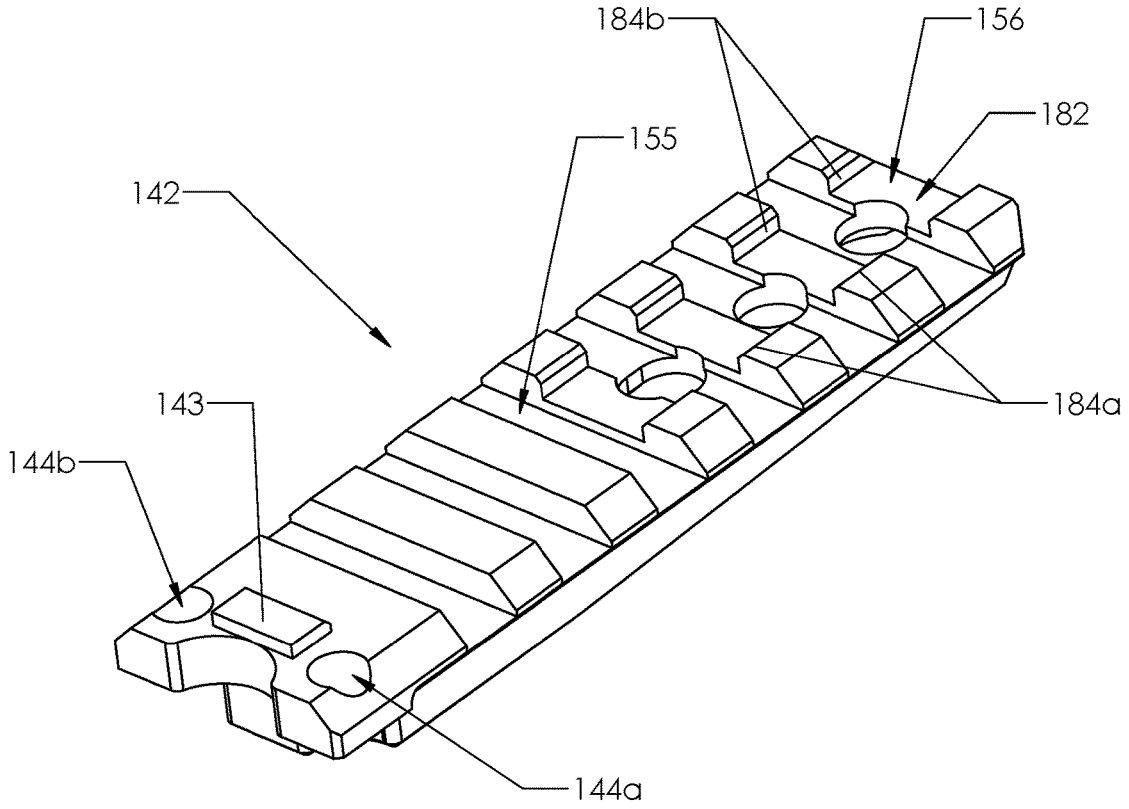
FIGS. 3 and 4 illustrate example accessory adaptors constructed in accordance with the principles of the present disclosure.

In some implementations, the forward accessory rail 142 may extend from a front side of the hub 100 when secured therewith (see, e.g., FIG. 1B). As shown in FIG. 3, in some implementations, the forward accessory rail 142 may include two openings 144*a*, 144*b* (referred to as openings 144 collectively) positioned adjacent the projection 143. In some implementations, the projection 143 may have the general shape of a rectangle. In some implementations, the projection 143 may be any suitable shape.

In some implementations, the openings 144 may extend through the forward accessory rail 142. In some implementations, there may be more than two or less than two openings 144. In some implementations, the two openings 144 may be threaded. In some implementations, the two openings 144 may not be threaded. In some implementations, the openings 144 may be positioned so that they are in line with the openings 112 of the hub 100 when the projection 143 of the forward accessory rail 142 has been received within the notch 117 of the hub 100. In this way, screws or other fasteners may be used to secure the forward accessory rail 142 to the hub 100.

In some implementations, a portion of the forward accessory rail 142 may include a MIL-STD-1913 rail interface on a top side 155 thereof. In some implementations, the top side 155 may include any other interface thereon which is currently known or developed in the future for use with a firearm and/or firearm accessories.

As shown in FIG. 3, in some implementations, a mounting interface 156 may be provided on a portion of the top side 155 of the forward accessory rail 142. In some implementations, the mounting interface 156 may be comprised of a channel 182. In some implementations, the channel 182 may be recessed into the top side 155 of the forward accessory rail 142. In some implementations, the channel 182 may be bound on two sides by a ridge 184*a*, 184*b* (referred to as ridges 184 collectively).

As shown in FIGS. 1A, 1B, in some implementations, an offset accessory rail 140 may be secured to the top side 110, first side 120 (see, e.g., FIG. 1B), and/or second side 125 of the hub 100. In some implementations, an offset accessory rail 140 may include a projection 141 on a bottom side thereof configured to be received within the channel 162 of the mounting interface 160 (see, e.g., FIG. 1A). In some implementations, the projection 141 may be configured to be received between the ridges 164 which define the channel 162 of a mounting interface 160. In some implementations, the projection 141 may have the general shape of a rectangle. In some implementations, the projection 141 may be any suitable shape.

As shown in FIG. 1A, in some implementations, a top side 151 of the offset accessory rail 140 may include a MIL-STD-1913 rail interface thereon. In some implementations, the top side 151 may include any other interface thereon which is currently known or developed in the future for use with a firearm and/or firearm accessories. In some implementations, the top side 151 of the offset accessory rail 140 may include a mounting interface (e.g., mounting interface 160, 156).

In some implementations, the offset accessory rail 140 may include three openings 152 extending therethrough (see, e.g., FIG. 1B). In some implementations, there may be more than three or less than three openings 152 extending therethrough. In some implementations, the three openings 152 may be threaded. In this way, screws may be used to secure the projection 141 of the offset accessory rail 140 within the channel 162 of a mounting interface 160 (see, e.g., FIG. 1B) by extending screws through openings 152 and openings 166. In some implementations, the three openings 152 may not be threaded. In some implementations, the openings 152 may extend through the projection 141 portion of the offset accessory rail 140.

As shown in FIG. 1A, in some implementations, the ring mount 145 may include a projection 146 on a bottom side thereof configured to be received within the channel 162 of a mounting interface 160. In some implementations, the projection 146 may be configured to be received between the ridges 164 which define the channel 162 of a mounting interface 160 (see, e.g., FIG. 1B). In some implementations, the projection 146 may have the general shape of a rectangle. In some implementations, the projection 146 may be any suitable shape.

In some implementations, the ring mount 145 may be configured to receive a flashlight therein. In some implementations, the ring mount 145 may be configured to receive any accessory suitably constructed to be received and retained within a clamp ring and/or scope ring.

In some implementations, the ring mount 145 may include two openings 147 extending therethrough (see, e.g., FIG. 1A). In some implementations, there may be more than two or less than two openings 147 extending therethrough. In some implementations, the two openings 147 may be threaded. In this way, screws may be used to secure the projection 146 of the ring mount 145 within the channel 162 of a mounting interface 160 (see, e.g., FIG. 1B) by extending screws through openings 147 and openings 166. In some implementations, the two openings 147 may not be threaded. In some implementations, the openings 147 may extend through the projection 146 portion of the ring mount 145 (see, e.g., FIG. 1A).

In some implementations, as shown in FIG. 4, an extension rail 170 may be comprised of a body portion 172 and a projection 174. In some implementations, the projection 174 may be configured to be received within the channel 162 of a mounting interface 160 (see, e.g., FIG. 4). In some implementations, at least a portion of the projection 174 may be configured to be received between the ridges 164 that define the channel 162 of a mounting interface 160. In some implementations, the projection 174 may have the general shape of a rectangle. In some implementations, the projection 174 may be any suitable shape. In some implementations, the top side 176 of the body portion 172 may include a MIL-STD-1913 rail interface thereon. In some implementations, the top side 176 may include any other interface thereon which is currently known or developed in the future for use with a firearm and/or firearm accessory.

As shown in FIG. 4, in some implementations, a mounting interface 178 may be provided on a portion of the top side 176 of the body portion 172 of the extension rail 170. In some implementations, the mounting interface 178 may be comprised of a channel 192. In some implementations, the channel 192 may be recessed into the top side 176 of the body portion 172 of the extension rail 170. In some implementations, the channel 192 may be bound on two sides by a ridge 194*a*, 194*b* (referred to as ridges 194 collectively). In some implementations, the mounting interface 178 on the top side 176 of an extension rail 170 may be configured to receive another accessory adaptor therein (e.g., an accessory mount having one or more clamp rings thereon configured to receive a flashlight therein).

In some implementations, the extension rail 170 may include three openings 175 extending through the projection 174 portion (see, e.g., FIG. 4). In some implementations, there may be more than three or less than three openings 175 extending through the projection 174 portion. In some implementations, the three openings 175 may be threaded. In this way, screws may be used to secure the projection 174 portion within the channel 162 of a mounting interface 160. In some implementations, the three openings 175 may not be threaded.

In some implementations, an accessory adaptor may be any article configured for attachment to a mounting interface 160. In some implementations, an accessory adaptor may have an accessory interface (e.g., a MIL-STD-1913 rail interface or any other interface thereon which is currently known or developed in the future for use with a firearm and/or firearm accessories) configured to receive thereon an accessory suitable for attachment and/or use with a firearm. For example, in some implementations, the accessory interface may be configured for a weapon light to be directly mounted thereto. In some implementations, the accessory interface may be configured for a laser to be directly mounted thereto. In some implementations, an accessory adaptor may have a mounting interface with a channel.

Figure 5A:
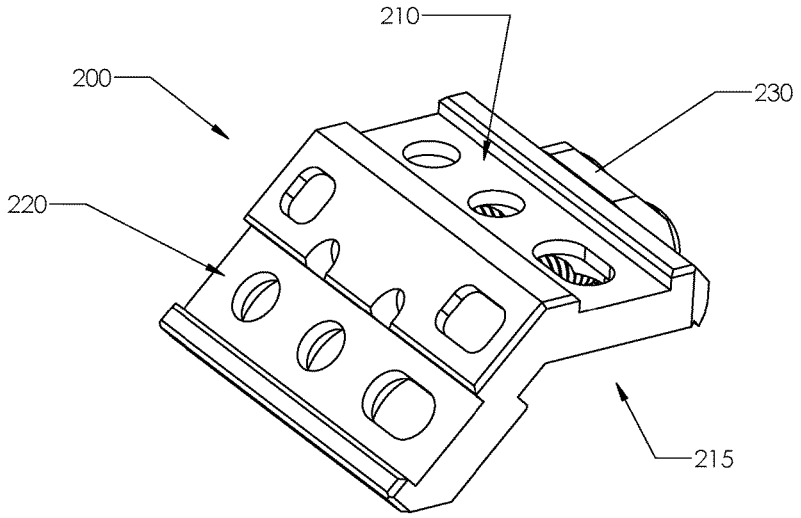
FIGS. 5A and 5B illustrate another example hub according to the present disclosure.
Figure 5B:
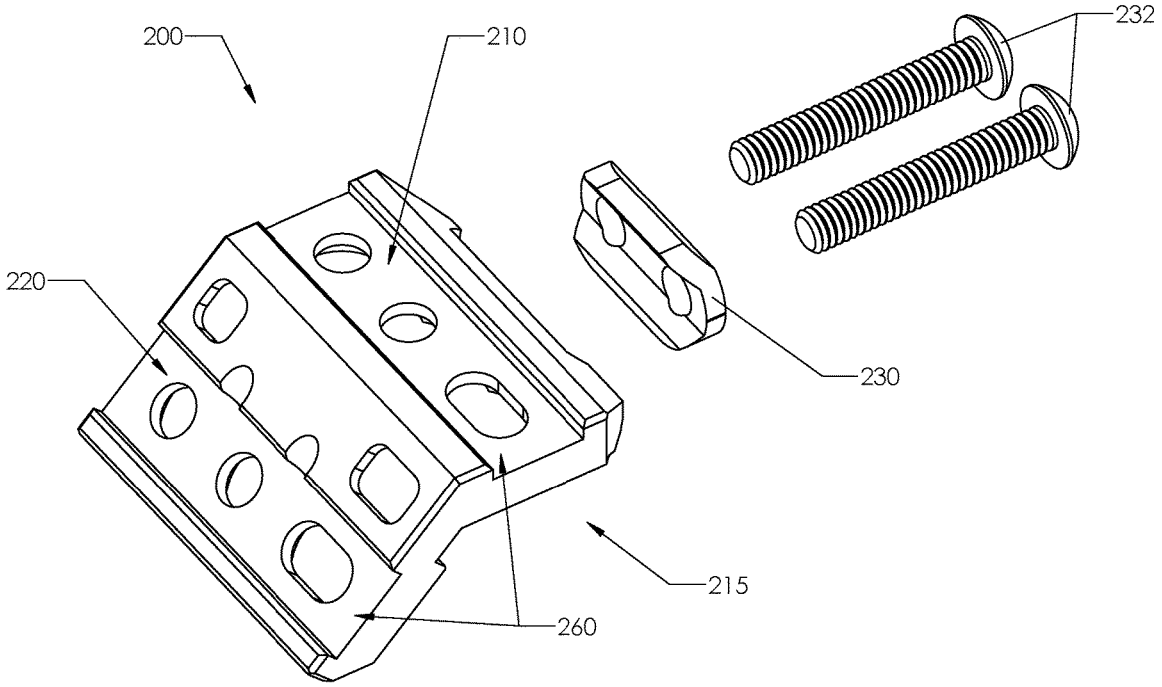

FIGS. 5A and 5B illustrate another example multiple accessory gun mount comprising a hub 200. As shown in FIGS. 5A and 5B, in some implementations, the hub 200 may be the same or substantially the same as the hub 100. In some implementations, the hub 200 of the multiple accessory gun mount may be comprised of a top side 210, a bottom side 215, and a first side 220 (see, e.g., FIG. 5A). In some implementations, the top side 210 and the first side 220 may each have a mounting interface 260 thereon. In some implementations, the bottom side 215 of the hub 200 may be configured to be secured to a firearm. In some implementations, two screws 232 and a clamp 230 may be used to secure the hub 200 to a suitable interface.

In some implementations, the accessory adaptors (such as an offset accessory rail 140, a forward accessory rail 142, a ring mount 145, and/or an extension rail 170) configured for attachment to the hub 100 shown in FIG. 2A are also suitable for attachment to the hub 200 shown in FIGS. 5A and 5B.

In some implementations, the hub 100, 200 may be manufactured of aluminum. In some implementations, the hub 100, 200 may be manufactured from a polymer. In some implementations, the hub 100, 200 may be manufactured from any material suitable for use as a mount for a firearm accessory (e.g., steel, titanium).

In some implementations, the accessory adaptors may be manufactured of aluminum. In some implementations, the accessory adaptors may be manufactured from a polymer. In some implementations, the accessory adaptors may be manufactured from any material suitable for use as a mount for a firearm accessory (e.g., steel, titanium).

In some implementations, a hub having one or more mounting interfaces thereon may be configured to fit about the barrel and tube of a shotgun. In some implementations, a hub having one or more mounting interfaces thereon may be configured to secure directly to a tubular handguard or other suitably constructed handguard. In some implementations, a hub having one or more mounting interfaces thereon may be configured to secure directly to a helmet.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A multiple accessory gun mount comprising:

a hub having a top side, a bottom side, and a first side, wherein the top side is directly adjacent to the bottom side and includes a first mounting interface thereon, the first side includes a second mounting interface thereon, and the bottom side is configured to be secured to a handguard positioned about a barrel of a firearm;

wherein the first mounting interface and the second mounting interface each include a channel extending between a first ridge and a second ridge, the channel is configured to receive a portion of an accessory adaptor therein;

at least one accessory adaptor having a projection thereon, the projection is configured to be received within the channel of the second mounting interface; and a front sight, the front sight includes a projection on a bottom side thereof configured to be received within the channel of the first mounting interface.

2. The multiple accessory gun mount of claim 1, wherein the hub further comprises a second side, the second side includes a third mounting interface thereon, the third mounting interface includes a channel extending between a first ridge and a second ridge, the channel is configured to receive a portion of an accessory adaptor therein; and wherein the projection of the at least one accessory adaptor is configured to be received within the channel of the third mounting interface.

3. The multiple accessory gun mount of claim 1, wherein the bottom side of the hub is configured to be secured to a helmet.

4. The multiple accessory gun mount of claim 1, wherein the at least one accessory adaptor includes an accessory interface on a top side thereof configured for a firearm accessory to be mounted thereto, the projection of the at least one accessory adaptor extends from a bottom side thereof.

5. The multiple accessory gun mount of claim 1, wherein the at least one accessory adaptor is an extension rail comprising a body portion and the projection, the projection extends from a backside of the body portion, the projection is configured to position the body portion of the extension rail in front of the hub, the body portion includes an accessory interface on a top side thereof configured for a firearm accessory to be mounted thereto.

6. The multiple accessory gun mount of claim 1, wherein the first side of the hub is at an angle relative to the top side of the hub.

7. The multiple accessory gun mount of claim 1, wherein the at least one accessory adaptor is a ring mount configured to retain a flashlight therein, the projection extends from a bottom side of the ring mount.

8. The multiple accessory gun mount of claim 1, wherein the at least one accessory adaptor includes an accessory interface on a top side thereof configured for a firearm accessory to be mounted thereto, the at least one accessory adaptor is configured to be secured directly to the bottom side of the hub and extend therefrom.

9. The multiple accessory gun mount of claim 8, wherein the projection of the at least one accessory adaptor extends from the top side thereof, the projection is configured to be received within a notch in the bottom side of the hub.

10. A multiple accessory gun mount comprising:

a hub having a top side, a bottom side, and a first side, wherein the top side is directly adjacent to the bottom side and includes a first mounting interface thereon, the first side includes a second mounting interface thereon, and the bottom side is configured to be secured to a handguard positioned about a barrel of a firearm;

wherein the first mounting interface and the second mounting interface each include a channel extending between a first ridge and a second ridge, the channel is configured to receive a portion of an electronic firearm accessory therein; and at least one electronic firearm accessory having a projection thereon, the projection is configured to be received within the channel of the first mounting interface and the second mounting interface.

11. The multiple accessory gun mount of claim 10, further comprising at least one accessory adaptor having a projection thereon, the projection is configured to be received within the channel of the first mounting interface and the second mounting interface.

12. The multiple accessory gun mount of claim 11, wherein the at least one accessory adaptor includes an accessory interface on a top side thereof configured for a firearm accessory to be mounted thereto, the projection of the at least one accessory adaptor extends from a bottom side thereof.

13. The multiple accessory gun mount of claim 11, wherein the at least one accessory adaptor is an extension rail comprising a body portion and the projection, the projection extends from a backside of the body portion, the projection is configured to position the body portion of the extension rail in front of the hub, the body portion includes an accessory interface on a top side thereof configured for a firearm accessory to be mounted thereto.

14. The multiple accessory gun mount of claim 11, wherein the at least one accessory adaptor is a ring mount configured to retain a flashlight therein, the projection extends from a bottom side of the ring mount.

15. The multiple accessory gun mount of claim 11, wherein the at least one accessory adaptor includes an accessory interface on a top side thereof configured for a firearm accessory to be mounted thereto, the at least one accessory adaptor is configured to be secured directly to the bottom side of the hub and extend therefrom.

16. The multiple accessory gun mount of claim 15, wherein the projection of the at least one accessory adaptor extends from the top side thereof, the projection is configured to be received within a notch in the bottom side of the hub.

17. The multiple accessory gun mount of claim 10, further comprising a front sight, the front sight includes a projection on a bottom side thereof configured to be received within the channel of the first mounting interface.

18. The multiple accessory gun mount of claim 10, wherein the hub further comprises a second side, the second side includes a third mounting interface thereon, the third mounting interface includes a channel extending between a first ridge and a second ridge, the channel is configured to receive a portion of an electronic firearm accessory therein; and wherein the projection of the at least one electronic firearm accessory is configured to be received within the channel of the third mounting interface.

19. The multiple accessory gun mount of claim 10, wherein the bottom side of the hub is configured to be secured to a helmet.

20. The multiple accessory gun mount of claim 10, wherein the first side of the hub is at an angle relative to the top side of the hub.

21. A multiple accessory gun mount comprising:

a hub having a top side, a bottom side, and a first side, wherein the top side is directly adjacent to the bottom side and includes a first mounting interface thereon, the first side includes a second mounting interface thereon, and the bottom side is configured to be secured to a handguard positioned about a barrel of a firearm;

wherein the first mounting interface and the second mounting interface each include a channel extending between a first ridge and a second ridge, the channel is configured to receive a portion of an accessory adaptor therein; and at least one accessory adaptor having a projection thereon, the at least one accessory adaptor is a ring mount configured to retain a flashlight therein, the projection extends from a bottom side of the ring mount and is configured to be received within the channel of the first mounting interface and the second mounting interface.

22. The multiple accessory gun mount of claim 21, wherein the hub further comprises a second side, the second side includes a third mounting interface thereon, the third mounting interface includes a channel extending between a first ridge and a second ridge, the channel is configured to receive a portion of an accessory adaptor therein; and wherein the projection of the at least one accessory adaptor is configured to be received within the channel of the third mounting interface.

23. The multiple accessory gun mount of claim 21, wherein the bottom side of the hub is configured to be secured to a helmet.

24. The multiple accessory gun mount of claim 21, further comprising a second accessory adaptor, the second accessory adaptor includes an accessory interface on a top side thereof configured for a firearm accessory to be mounted thereto and a projection extending from a bottom side thereof, the projection is configured to be received within the channel of the first mounting interface and the second mounting interface.

25. The multiple accessory gun mount of claim 21, further comprising a front sight, the front sight includes a projection on a bottom side thereof configured to be received within the channel of the first mounting interface.

26. The multiple accessory gun mount of claim 21, further comprising a second accessory adaptor, the second accessory adaptor is an extension rail comprising a body portion and a projection, a portion of the projection is configured to be received within the channel of the first mounting interface and the second mounting interface, the projection extends from a backside of the body portion, the projection is configured to position the body portion of the extension rail in front of the hub, the body portion includes an accessory interface on a top side thereof configured for a firearm accessory to be mounted thereto.

27. The multiple accessory gun mount of claim 21, wherein the first side of the hub is at an angle relative to the top side of the hub.

28. The multiple accessory gun mount of claim 21, further comprising a second accessory adaptor, the second accessory adaptor includes an accessory interface on a top side thereof configured for a firearm accessory to be mounted thereto, the at least one accessory adaptor is configured to be secured directly to the bottom side of the hub and extend therefrom.

29. The multiple accessory gun mount of claim 28, wherein the projection of the at least one accessory adaptor extends from the top side thereof, the projection is configured to be received within a notch in the bottom side of the hub.

* * * * *